US011644269B2

(12) United States Patent
Jen

(10) Patent No.: US 11,644,269 B2
(45) **Date of Patent: *May 9, 2023**

(54) TOOL-FREE DUST COVER FOR FIREARMS

(71) Applicant: Strike Industries, Inc., Santa Ana, CA (US)

(72) Inventor: YiHuei Jen, Santa Ana, CA (US)

(73) Assignee: Strike Industries, Inc., Santa Ana, CA (US)

( * ) Notice: Subject to any disclaimer, the term of this patent is extended or adjusted under 35 U.S.C. 154(b) by 13 days.

This patent is subject to a terminal disclaimer.

(21) Appl. No.: 17/371,232

(22) Filed: Jul. 9, 2021

(65) Prior Publication Data

US 2021/0341251 A1 Nov. 4, 2021

Related U.S. Application Data

(63) Continuation of application No. 16/702,878, filed on Dec. 4, 2019, now Pat. No. 11,085,727.

(60) Provisional application No. 62/776,368, filed on Dec. 6, 2018.

(51) Int. Cl.
*F41A 35/02* (2006.01)

(52) U.S. Cl.
CPC ..... *F41A 35/02* (2013.01)

(58) Field of Classification Search
CPC ..... F41A 35/02; F41A 35/06; F41A 35/00
See application file for complete search history.

(56) References Cited

U.S. PATENT DOCUMENTS 1,201,189 A * 10/1916 Johnson ..... F41A 9/60 42/98
2,916,844 A * 12/1959 Hellstrom ..... F41A 35/02 89/196
2,940,201 A * 6/1960 Reed ..... F41A 35/02 89/197
3,153,981 A * 10/1964 Brass ..... F41A 9/60 42/98
3,609,900 A * 10/1971 Bernocco, Jr. ..... F41A 9/60 42/98
3,739,685 A * 6/1973 Lundgren ..... F41A 9/60 89/33.4
3,881,268 A * 5/1975 Petersen ..... F41A 9/60 42/98
3,999,318 A * 12/1976 Tellie ..... F41A 35/02 42/106

(Continued)

*Primary Examiner* — Michelle Clement
(74) *Attorney, Agent, or Firm* — Han IP PLLC; Andy M. Han

(57) ABSTRACT

Various examples of a tool-free dust cover for firearms are described. The dust cover is a monolithic piece having a cover plate, a first connection portion, and a second connection portion, with at least one of the first connection portion and the second connection portion being elastically deformable to allow the dust cover to be pivotably coupled to a receiver portion of the firearm. The first connection portion is received in a cavity of a first hinge knuckle on the receiver portion next to a first long side of an ejection port of the receiver portion. The second connection portion is received in a cavity of a second hinge knuckle on the receiver portion next to the first long side of the ejection port. When in an open position, the cover plate uncovers the ejection port. When in a closed position, the cover plate covers the ejection port.

20 Claims, 4 Drawing Sheets

(56) References Cited

U.S. PATENT DOCUMENTS 4,020,738 A * 5/1977 Martinez ..... F41A 9/60 89/33.4
4,028,834 A * 6/1977 Dobson ..... F41A 9/60 42/98
4,265,042 A * 5/1981 Isola ..... F41A 9/60 42/98
4,334,375 A * 6/1982 Olson ..... F41A 9/60 42/98
4,594,803 A * 6/1986 Muncy ..... F41A 9/60 42/98
4,621,444 A * 11/1986 Anderson ..... F41A 9/56 42/98
4,715,141 A * 12/1987 Kohnke ..... F41A 9/60 42/98
4,903,426 A * 2/1990 Bammate ..... F41A 9/60 42/98
5,285,593 A * 2/1994 Bammate ..... F41A 9/60 42/98
5,918,401 A * 7/1999 Rowlands ..... F41A 35/02 42/16
7,389,605 B1 * 6/2008 Clark ..... F41A 9/60 42/98
9,188,405 B2 * 11/2015 Hawley ..... F41A 35/02
9,395,131 B1 * 7/2016 Clark ..... F41A 35/02
9,612,075 B1 * 4/2017 Stephens, IV ..... F41A 35/02
9,958,229 B1 * 5/2018 Meier ..... F41A 35/02
9,970,728 B1 * 5/2018 Huang ..... F41A 35/02
10,393,467 B1 * 8/2019 Ding ..... F41A 35/02
10,527,377 B2 * 1/2020 Larish ..... F41A 15/12
D888,869 S * 6/2020 Chin ..... D22/108
11,085,727 B2 * 8/2021 Jen ..... F41A 35/02
2003/0230020 A1 * 12/2003 Christiansen ..... F41A 17/44 42/1.05
2005/0016051 A1 * 1/2005 Fischbach ..... F41A 35/06 42/96
2006/0101699 A1 * 5/2006 Perez ..... F41A 9/60 42/98
2014/0196338 A1 * 7/2014 Lessard ..... F41A 35/02 42/16
2017/0268840 A1 * 9/2017 Rowe ..... F41F 1/10
2017/0343312 A1 * 11/2017 Tamir ..... F41A 35/06
2020/0240740 A1 * 7/2020 Jen ..... F41A 35/02

* cited by examiner

TOOL-FREE DUST COVER FOR FIREARMS

CROSS REFERENCE TO RELATED PATENT APPLICATION(S)

The present disclosure is part of a continuation of U.S. patent application Ser. No. 16/702,878, filed 4 Dec. 2019, which claims the priority benefit of U.S. Patent Application No. 62/776,368, filed 6 Dec. 2018. The contents of aforementioned applications are herein incorporated by reference in their entirety.

TECHNICAL FIELD

The present disclosure is generally related to firearms and, more particularly, to a tool-free dust cover for firearms.

BACKGROUND

Unless otherwise indicated herein, approaches described in this section are not prior art to the claims listed below and are not admitted as prior art by inclusion in this section.

On firearms such as rifles, carbines and pistols based on the AR-15 platform, casings of spent rounds of ammunition cartridges are ejected out of a receiver portion of the firearm through an ejection port. To prevent dust and debris from entering the ejection port, an ejection port dust cover (herein interchangeably referred to as "dust cover" and "ejection port cover") is typically provided to cover up the ejection port. However, when a user intends to remove or replace the dust cover (e.g., for cleaning or customization), a tool is usually needed since a conventional design of the dust cover utilizes a spring-loaded pin to securely couple the dust cover onto the receiver portion of the firearm.

SUMMARY

The following summary is illustrative only and is not intended to be limiting in any way. That is, the following summary is provided to introduce concepts, highlights, benefits and advantages of the novel and non-obvious techniques described herein. Select implementations are further described below in the detailed description. Thus, the following summary is not intended to identify essential features of the claimed subject matter, nor is it intended for use in determining the scope of the claimed subject matter.

An objective of the present disclosure is to provide innovative designs of a dust cover that can be mounted to and removed from a receiver portion (e.g., upper receiver) of a firearm (e.g., an AR-15 style firearm) without the need or use of a tool. Thus, a dust cover in accordance with the present disclosure may be considered a tool-free dust cover.

In one aspect, a device implementable on a firearm may include a dust cover as a monolithic piece having a plurality of components including a cover plate, a first connection portion, and a second connection portion. At least one of the first connection portion and the second connection portion of the dust cover may be elastically deformable to allow the dust cover to be pivotably coupled to a receiver portion of the firearm such that: (a) the first connection portion of the dust cover is received in a cavity of a first hinge knuckle on the receiver portion of the firearm next to a first long side of an ejection port of the receiver portion of the firearm, and (b) the second connection portion of the dust cover is received in a cavity of a second hinge knuckle on the receiver portion of the firearm next to the first long side of the ejection port. When the dust cover is in an open position on the receiver portion of the firearm, the cover plate may uncover the ejection port. When the dust cover is in a closed position on the receiver portion of the firearm, the cover plate may cover the ejection port.

In one aspect, a device implementable on a firearm may include a dust cover as a monolithic piece having a plurality of components including a cover plate, a first connection portion, a second connection portion, and a third connection portion. The dust cover may be pivotably coupled to a receiver portion of the firearm without any pin such that: (a) the first connection portion of the dust cover is received in a cavity of a first hinge knuckle on the receiver portion of the firearm next to a first long side of an ejection port of the receiver portion of the firearm, and (b) the second connection portion of the dust cover is received in a cavity of a second hinge knuckle on the receiver portion of the firearm next to the first long side of the ejection port. When the dust cover is in an open position on the receiver portion of the firearm, the cover plate may uncover the ejection port. When the dust cover is in a closed position on the receiver portion of the firearm, the cover plate may cover the ejection port. Moreover, when the dust cover is in the closed position on the receiver portion of the firearm, the third connection portion may latch onto a second long side of the ejection port opposite the first long side thereof.

In one aspect, an apparatus may include a firearm and a dust cover. The firearm may include a receiver portion having an ejection port. The dust cover may be a monolithic piece having a plurality of components including a cover plate, a first connection portion, and a second connection portion. At least one of the first connection portion and the second connection portion of the dust cover may be elastically deformable to allow the dust cover to be pivotably coupled to the receiver portion of the firearm such that: (a) the first connection portion of the dust cover is received in a cavity of a first hinge knuckle on the receiver portion of the firearm next to a first long side of the ejection port, and (b) the second connection portion of the dust cover is received in a cavity of a second hinge knuckle on the receiver portion of the firearm next to the first long side of the ejection port. When the dust cover is in an open position on the receiver portion of the firearm, the cover plate may uncover the ejection port. When the dust cover is in a closed position on the receiver portion of the firearm, the cover plate may cover the ejection port.

BRIEF DESCRIPTION OF THE DRAWINGS

The accompanying drawings are included to provide a further understanding of the disclosure, and are incorporated in and constitute a part of the present disclosure. The drawings illustrate implementations of the disclosure and, together with the description, serve to explain the principles of the disclosure. It is appreciable that the drawings are not necessarily in scale as some components may be shown to be out of proportion than the size in actual implementation in order to clearly illustrate the concept of the present disclosure.

DETAILED DESCRIPTION OF PREFERRED IMPLEMENTATIONS

Detailed embodiments and implementations of the claimed subject matters are disclosed herein. However, it shall be understood that the disclosed embodiments and implementations are merely illustrative of the claimed subject matters which may be embodied in various forms. The present disclosure may, however, be embodied in many different forms and should not be construed as limited to the exemplary embodiments and implementations set forth herein. Rather, these exemplary embodiments and implementations are provided so that description of the present disclosure is thorough and complete and will fully convey the scope of the present disclosure to those skilled in the art. In the description below, details of well-known features and techniques may be omitted to avoid unnecessarily obscuring the presented embodiments and implementations.

OVERVIEW

Figure 1:
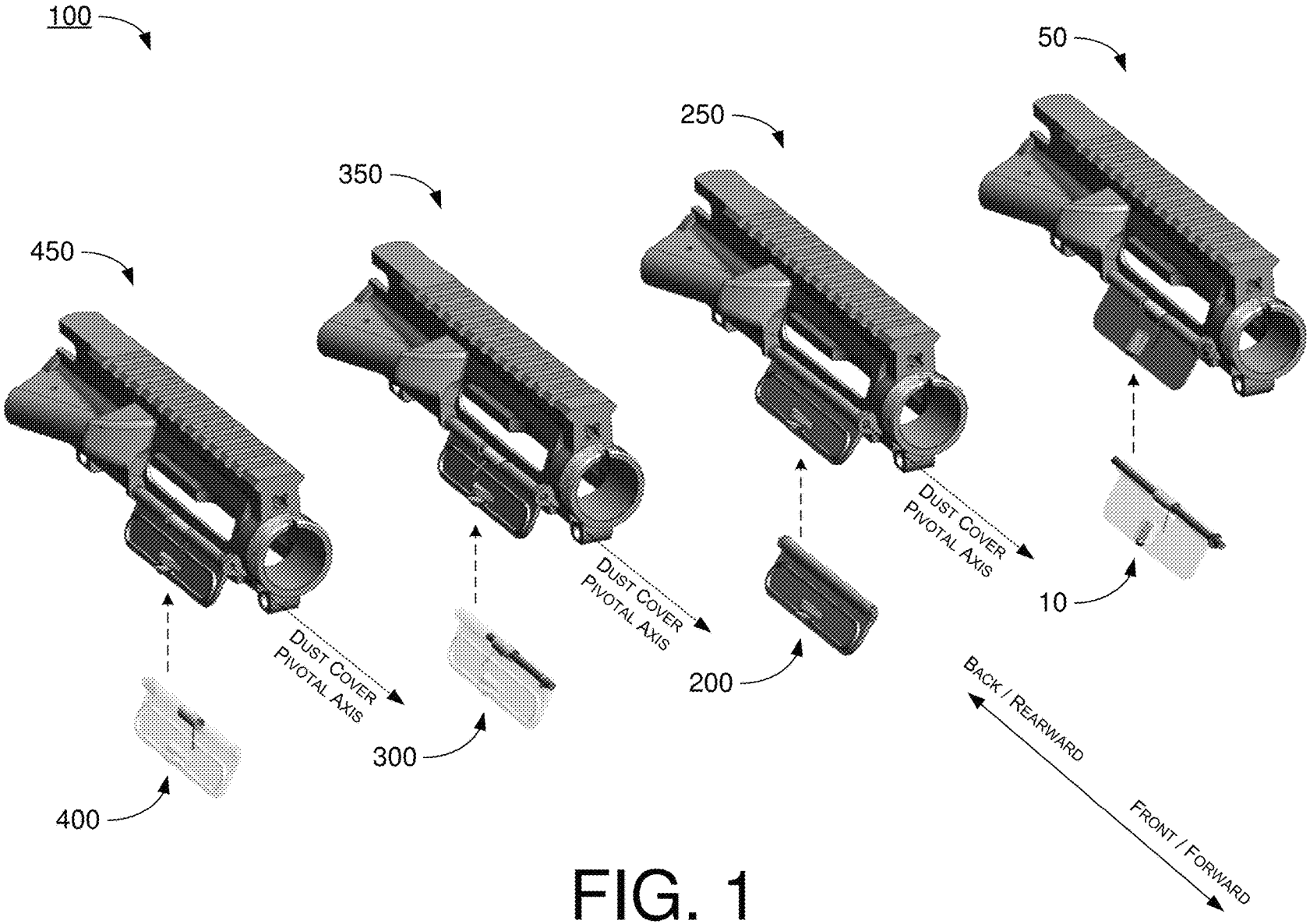
FIG. 1 is a diagram of a display of various designs in accordance with an implementation of the present disclosure.

FIG. 1 illustrates a display 100 of various designs in accordance with an implementation of the present disclosure. In display 100, a conventional dust cover 10 as well as a dust cover 200, a dust cover 300 and a dust cover 400 in accordance with the present disclosure are shown. Each of dust cover 10, 200, 300 and 400 may be pivotably mounted on or otherwise coupled to a receiver portion (e.g., upper receiver) of a firearm (e.g., AR-15 style firearm). In the example shown in FIG. 1, dust cover 10 may be pivotably mounted on or otherwise coupled to a receiver portion 50, dust cover 200 may be pivotably mounted on or otherwise coupled to a receiver portion 250, dust cover 300 may be pivotably mounted on or otherwise coupled to a receiver portion 350, and dust cover 400 may be pivotably mounted on or otherwise coupled to a receiver portion 450. When pivotably mounted on or otherwise coupled to the respective receiver portion of the firearm, each of dust covers 200, 300 and 400 may be pivoted between a closed position and an open position. Specifically, when each of dust covers 200, 300 and 400 is in the open position on the receiver portion of the firearm, each of dust covers 200, 300 and 400 may cover an ejection port of the receiver portion. Moreover, when each of dust covers 200, 300 and 400 is in the closed position on the receiver portion of the firearm, each of dust covers 200, 300 and 400 may uncover the ejection port of the receiver portion.

Illustrative Implementations

Figure 2:
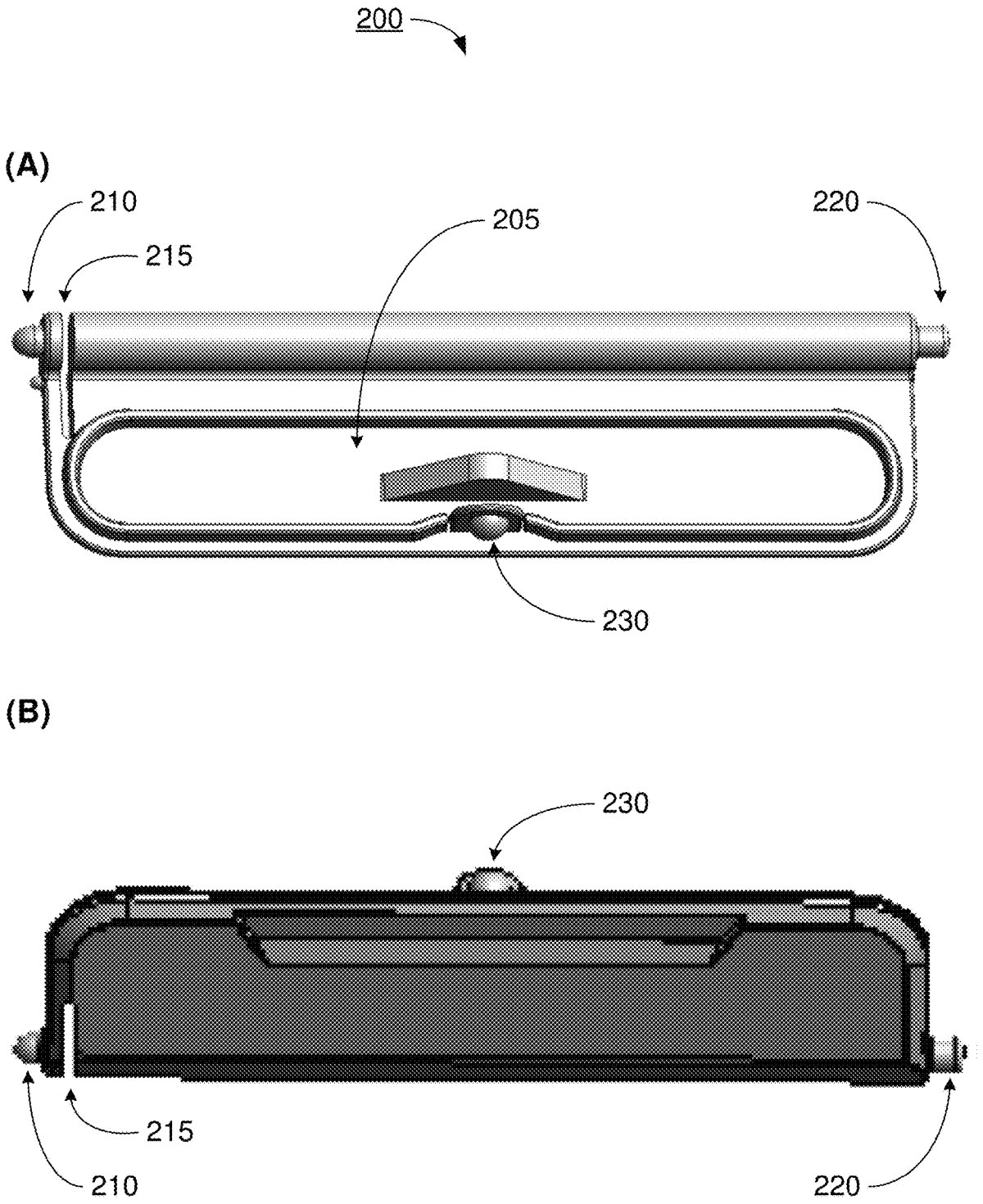
FIG. 2 is a diagram of a dust cover in accordance with an implementation of the present disclosure.

FIG. 2 illustrates dust cover 200 in accordance with an implementation of the present disclosure. Dust cover 200 may be a monolithic piece having a plurality of components including a cover plate 205, a first connection portion 210 and a second connection portion 220. At least one of the first connection portion 210 and the second connection portion 220 of dust cover 200 may be elastically deformable to allow dust cover 200 to be pivotably coupled to a receiver portion (e.g., receiver portion 250) of a firearm. In particular, the first connection portion 210 of dust cover 200 may be received in a cavity of a first hinge knuckle on receiver portion 250 next to a first long side of an ejection port of receiver portion 250. Moreover, the second connection portion 220 of dust cover 200 may be received in a cavity of a second hinge knuckle on receiver portion 250 next to the first long side of the ejection port. Thus, when dust cover 200 is in an open position on receiver portion 250, cover plate 205 may uncover the ejection port, and when dust cover 200 is in a closed position on receiver portion 250, cover plate 205 may cover the ejection port.

In some implementations, the at least one of the first connection portion 210 and the second connection portion 220 that is elastically deformable may be separated from cover plate 205 by a gap which, when dust cover 200 is coupled to receiver portion 250, extends radially from a dust cover pivotal axis around which dust cover 200 is pivotably coupled to receiver portion 250. For instance, as shown in FIG. 2, the first connection portion 210 may be separated from cover plate 205 by a gap 215. Gap 215 allows the first connection portion 210 to be temporarily and elastically deformed (e.g., pressed in a direction towards the second connection portion 220 such that a width of gap 215 is reduced), thereby temporarily reducing a dimension measured between the first connection portion 210 to the second connection portion 220, such that a hinge joint on the first connection portion 210 and a hinge joint on the second connection portion 220 may be respectively received in a cavity of a first hinge knuckle on receiver portion 250 and a cavity of a second hinge knuckle on receiver portion 250 next to the ejection port to pivotably couple dust cover 200 to receiver portion 250.

In some implementations, the plurality of components of dust cover 200 may also include a third connection portion 230. When dust cover 200 is in the closed position on receiver portion 250, the third connection portion 230 latches onto a second long side of the ejection port opposite the first long side thereof. For example, referring to FIG. 2, the third connection portion 230 may be elastically deformable to allow a protrusion or bump on the third connection portion 230 to latch onto the second long side of the ejection port. As the third connection portion 230 is elastically deformable and is an integral part of the monolithic piece of dust cover 200, there is no need of external components, such as a plunger and spring, as in conventional designs. Advantageously, this can save both the cost and time in manufacturing.

In some implementations, dust cover 200 may be made of polymer. Alternatively, dust cover 200 may be made of metal.

Figure 3:
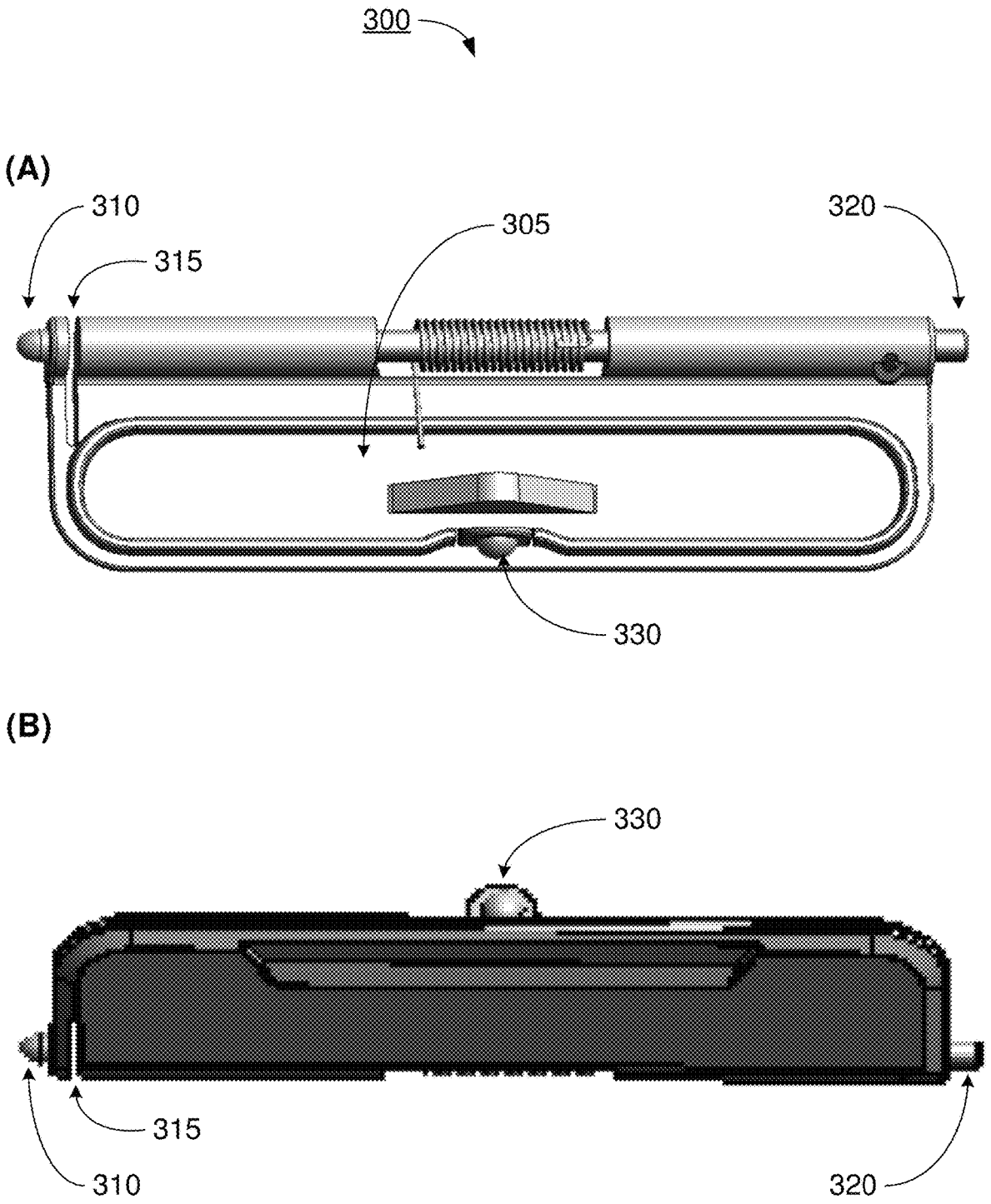
FIG. 3 is a diagram of a dust cover in accordance with an implementation of the present disclosure.

FIG. 3 illustrates dust cover 300 in accordance with an implementation of the present disclosure. Dust cover 300 may be a monolithic piece having a plurality of components including a cover plate 305, a first connection portion 310 and a second connection portion 320. At least one of the first connection portion 310 and the second connection portion 320 of dust cover 300 may be elastically deformable to allow dust cover 300 to be pivotably coupled to a receiver portion (e.g., receiver portion 350) of a firearm. In particular, the first connection portion 310 of dust cover 300 may be received in a cavity of a first hinge knuckle on receiver portion 350 next to a first long side of an ejection port of receiver portion 350. Moreover, the second connection portion 320 of dust cover 300 may be received in a cavity of a second hinge knuckle on receiver portion 350 next to the first long side of the ejection port. Thus, when dust cover 300 is in an open position on receiver portion 350, cover plate 305 may uncover the ejection port, and when dust cover 300 is in a closed position on receiver portion 350, cover plate 305 may cover the ejection port.

In some implementations, the at least one of the first connection portion 310 and the second connection portion 320 that is elastically deformable may be separated from cover plate 305 by a gap which, when dust cover 300 is coupled to receiver portion 350, extends radially from a dust cover pivotal axis around which dust cover 300 is pivotably coupled to receiver portion 350. For instance, as shown in FIG. 3, the first connection portion 310 may be separated from cover plate 305 by a gap 315. Gap 315 allows the first connection portion 310 to be temporarily and elastically deformed (e.g., pressed in a direction towards the second connection portion 320 such that a width of gap 315 is reduced), thereby temporarily reducing a dimension measured between the first connection portion 310 to the second connection portion 320, such that a hinge joint on the first connection portion 310 and a hinge joint on the second connection portion 320 may be respectively received in a cavity of a first hinge knuckle on receiver portion 350 and a cavity of a second hinge knuckle on receiver portion 350 next to the ejection port to pivotably couple dust cover 300 to receiver portion 350.

In some implementations, the plurality of components of dust cover 300 may also include a third connection portion 330. When dust cover 300 is in the closed position on receiver portion 350, the third connection portion 330 latches onto a second long side of the ejection port opposite the first long side thereof. For example, referring to FIG. 3, the third connection portion 330 may be elastically deformable to allow a protrusion or bump on the third connection portion 330 to latch onto the second long side of the ejection port. As the third connection portion 330 is elastically deformable and is an integral part of the monolithic piece of dust cover 300, there is no need of external components, such as a plunger and spring, as in conventional designs. Advantageously, this can save both the cost and time in manufacturing.

In some implementations, dust cover 300 may be made of polymer. Alternatively, dust cover 300 may be made of metal.

Figure 4:
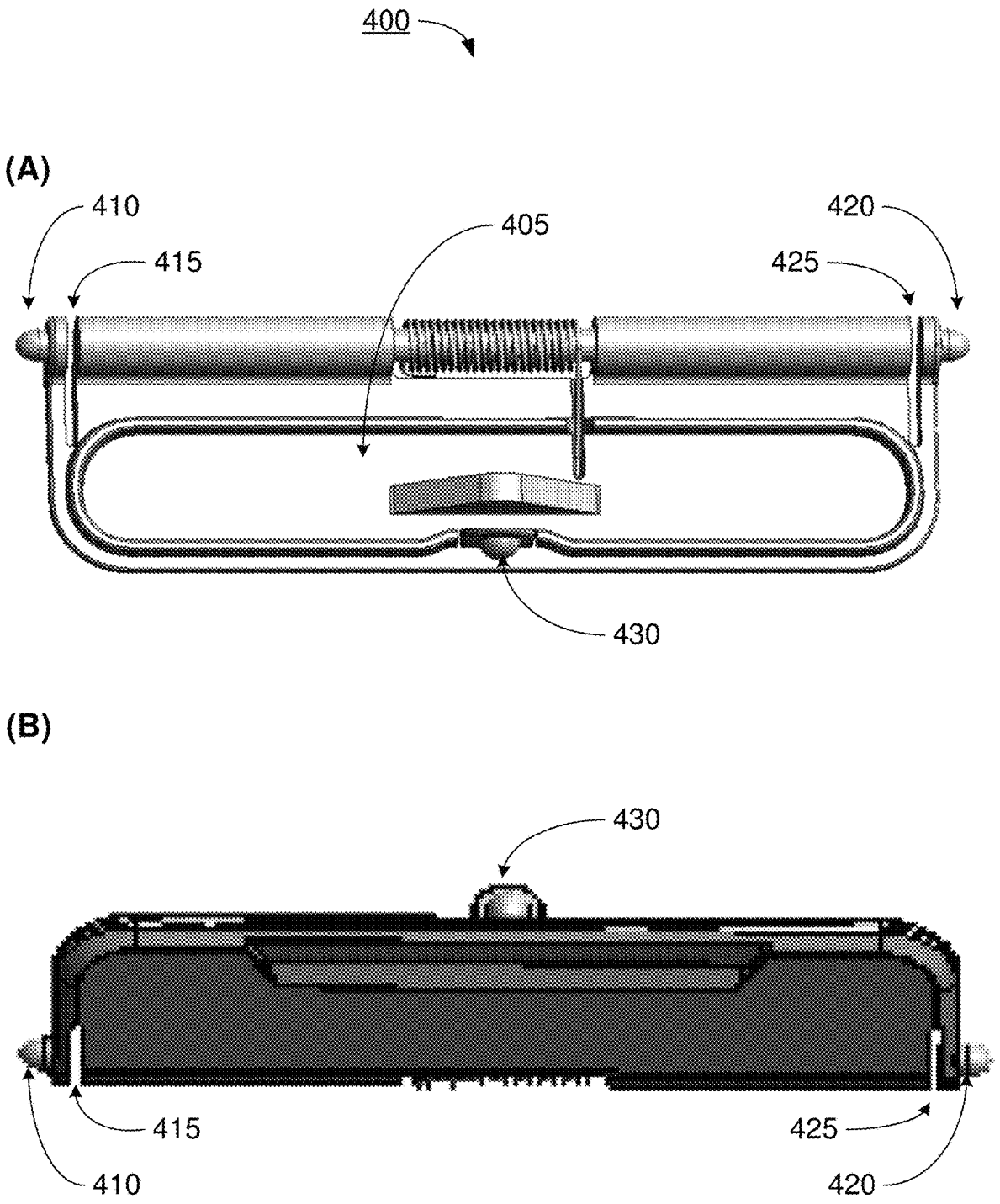
FIG. 4 is a diagram of a dust cover in accordance with an implementation of the present disclosure.

FIG. 4 illustrates dust cover 400 in accordance with an implementation of the present disclosure. Dust cover 400 may be a monolithic piece having a plurality of components including a cover plate 405, a first connection portion 410 and a second connection portion 420. At least one of the first connection portion 410 and the second connection portion 420 of dust cover 400 may be elastically deformable to allow dust cover 400 to be pivotably coupled to a receiver portion (e.g., receiver portion 450) of a firearm. In particular, the first connection portion 410 of dust cover 400 may be received in a cavity of a first hinge knuckle on receiver portion 450 next to a first long side of an ejection port of receiver portion 450. Moreover, the second connection portion 420 of dust cover 400 may be received in a cavity of a second hinge knuckle on receiver portion 450 next to the first long side of the ejection port. Thus, when dust cover 400 is in an open position on receiver portion 450, cover plate 405 may uncover the ejection port, and when dust cover 400 is in a closed position on receiver portion 450, cover plate 405 may cover the ejection port.

In some implementations, the at least one of the first connection portion 410 and the second connection portion 420 that is elastically deformable may be separated from cover plate 405 by a gap which, when dust cover 400 is coupled to receiver portion 450, extends radially from a dust cover pivotal axis around which dust cover 400 is pivotably coupled to receiver portion 450. For instance, as shown in FIG. 4, the first connection portion 410 may be separated from cover plate 405 by a gap 415, and the second connection portion 420 may be separate from cover plate 405 by a gap 425. Gap 415 allows the first connection portion 410 to be temporarily and elastically deformed (e.g., pressed in a direction towards the second connection portion 420 such that a width of gap 415 is reduced), thereby temporarily reducing a dimension measured between the first connection portion 410 to the second connection portion 420, such that a hinge joint on the first connection portion 410 and a hinge joint on the second connection portion 420 may be respectively received in a cavity of a first hinge knuckle on receiver portion 450 and a cavity of a second hinge knuckle on receiver portion 450 next to the ejection port to pivotably couple dust cover 400 to receiver portion 450. Similarly, gap 425 allows the second connection portion 420 to be temporarily and elastically deformed (e.g., pressed in a direction towards the second connection portion 410 such that a width of gap 425 is reduced), thereby temporarily reducing a dimension measured between the first connection portion 410 to the second connection portion 420, such that a hinge joint on the first connection portion 410 and a hinge joint on the second connection portion 420 may be respectively received in a cavity of a first hinge knuckle on receiver portion 450 and a cavity of a second hinge knuckle on receiver portion 450 next to the ejection port to pivotably couple dust cover 400 to receiver portion 450.

In some implementations, the plurality of components of dust cover 400 may also include a third connection portion 430. When dust cover 400 is in the closed position on receiver portion 450, the third connection portion 430 latches onto a second long side of the ejection port opposite the first long side thereof. For example, referring to FIG. 4, the third connection portion 430 may be elastically deformable to allow a protrusion or bump on the third connection portion 430 to latch onto the second long side of the ejection port. As the third connection portion 430 is elastically deformable and is an integral part of the monolithic piece of dust cover 400, there is no need of external components, such as a plunger and spring, as in conventional designs. Advantageously, this can save both the cost and time in manufacturing.

In some implementations, dust cover 400 may be made of polymer. Alternatively, dust cover 400 may be made of metal.

Feature Highlight

In view of the above, select features of various implementations in accordance with the present disclosure are highlighted below.

In one aspect, a device implementable on a firearm may include a dust cover as a monolithic piece that has a plurality of components including a cover plate, a first connection portion, and a second connection portion. At least one of the first connection portion and the second connection portion of the dust cover may be elastically deformable to allow the dust cover to be pivotably coupled to a receiver portion of the firearm such that: (a) the first connection portion of the dust cover is received in a cavity of a first hinge knuckle on the receiver portion of the firearm next to a first long side of the ejection port, and (b) the second connection portion of the dust cover is received in a cavity of a second hinge knuckle on the receiver portion of the firearm next to the first long side of the ejection port. When the dust cover is in an open position on the receiver portion of the firearm, the cover plate may uncover an ejection port of the receiver portion of the firearm. When the dust cover is in a closed position on the receiver portion of the firearm, the cover plate may cover the ejection port.

In some implementations, the at least one of the first connection portion and the second connection portion that is elastically deformable may be separated from the cover plate by a gap which, when the dust cover is coupled to the receiver portion of the firearm, extends radially from a dust cover pivotal axis around which the dust cover is pivotably coupled to the receiver portion of the firearm.

In some implementations, the plurality of components of the dust cover may further include a third connection portion. Accordingly, when the dust cover is in the closed position on the receiver portion of the firearm, the third connection portion may latch onto a second long side of the ejection port opposite the first long side thereof.

In some implementations, the third connection portion may be elastically deformable to allow a protrusion on the third connection portion to latch onto the second long side of the ejection port.

In some implementations, the dust cover may be made of polymer.

In some implementations, the dust cover may be made of metal.

In another aspect, a device implementable on a firearm may include a dust cover as a monolithic piece that has a plurality of components including a cover plate, a first connection portion, a second connection portion, and a third connection portion. The dust cover may be pivotably coupled to a receiver portion of the firearm without any pin such that: (a) the first connection portion of the dust cover is received in a cavity of a first hinge knuckle on the receiver portion of the firearm next to a first long side of the ejection port, and (b) the second connection portion of the dust cover is received in a cavity of a second hinge knuckle on the receiver portion of the firearm next to the first long side of the ejection port. When the dust cover is in an open position on the receiver portion of the firearm, the cover plate may uncover an ejection port of the receiver portion of the firearm. When the dust cover is in a closed position on the receiver portion of the firearm, the cover plate may cover the ejection port. Moreover, when the dust cover is in the closed position on the receiver portion of the firearm, the third connection portion may latch onto a second long side of the ejection port opposite the first long side thereof.

In some implementations, the third connection portion may be elastically deformable to allow a protrusion on the third connection portion to latch onto the second long side of the ejection port.

In some implementations, at least one of the first connection portion and the second connection portion of the dust cover may be elastically deformable to allow the dust cover to be pivotably coupled to a receiver portion of the firearm.

In some implementations, the at least one of the first connection portion and the second connection portion that is elastically deformable may be separated from the cover plate by a gap which, when the dust cover is coupled to the receiver portion of the firearm, extends radially from a dust cover pivotal axis around which the dust cover is pivotably coupled to the receiver portion of the firearm.

In some implementations, the dust cover may be made of polymer.

In some implementations, the dust cover may be made of metal.

In yet another aspect, an apparatus may include a firearm and a dust cover. The firearm may include a receiver portion having an ejection port. The dust cover may be a monolithic piece having a plurality of components including a cover plate, a first connection portion, and a second connection portion. At least one of the first connection portion and the second connection portion of the dust cover may be elastically deformable to allow the dust cover to be pivotably coupled to the receiver portion of the firearm such that: (a) the first connection portion of the dust cover is received in a cavity of a first hinge knuckle on the receiver portion of the firearm next to a first long side of the ejection port, and (b) the second connection portion of the dust cover is received in a cavity of a second hinge knuckle on the receiver portion of the firearm next to the first long side of the ejection port. When the dust cover is in an open position on the receiver portion of the firearm, the cover plate may uncover an ejection port of the receiver portion of the firearm. When the dust cover is in a closed position on the receiver portion of the firearm, the cover plate may cover the ejection port.

In some implementations, the at least one of the first connection portion and the second connection portion that is elastically deformable may be separated from the cover plate by a gap which, when the dust cover is coupled to the receiver portion of the firearm, extends radially from a dust cover pivotal axis around which the dust cover is pivotably coupled to the receiver portion of the firearm.

In some implementations, the plurality of components of the dust cover may further include a third connection portion. Accordingly, when the dust cover is in a closed position on the receiver portion of the firearm, the third connection portion may latch onto a second long side of the ejection port opposite the first long side thereof.

In some implementations, the third connection portion may be elastically deformable to allow a protrusion on the third connection portion to latch onto the second long side of the ejection port.

In some implementations, the dust cover may be made of polymer.

In some implementations, the dust cover may be made of metal.

In some implementations, the receiver portion may include a receiver based on an AR-15 platform.

In some implementations, the firearm may include a rifle, carbine or pistol based on an AR-15 platform.

Additional Notes

The herein-described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

Further, with respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

Moreover, it will be understood by those skilled in the art that, in general, terms used herein, and especially in the appended claims, e.g., bodies of the appended claims, are generally intended as "open" terms, e.g., the term "including" should be interpreted as "including but not limited to," the term "having" should be interpreted as "having at least," the term "includes" should be interpreted as "includes but is not limited to," etc. It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to implementations containing only one such recitation, even when the same claim includes the introductory phrases "one or more" or "at least one" and indefinite articles such as "a" or "an," e.g., "a" and/or "an" should be interpreted to mean "at least one" or "one or more;" the same holds true for the use of definite articles used to introduce claim recitations. In addition, even if a specific number of an introduced claim recitation is explicitly recited, those skilled in the art will recognize that such recitation should be interpreted to mean at least the recited number, e.g., the bare recitation of "two recitations," without other modifiers, means at least two recitations, or two or more recitations. Furthermore, in those instances where a convention analogous to "at least one of A, B, and C, etc." is used, in general such a construction is intended in the sense one having skill in the art would understand the convention, e.g., "a system having at least one of A, B, and C" would include but not be limited to systems that have A alone, B alone, C alone, A and B together, A and C together, B and C together, and/or A, B, and C together, etc. In those instances where a convention analogous to "at least one of A, B, or C, etc." is used, in general such a construction is intended in the sense one having skill in the art would understand the convention, e.g., "a system having at least one of A, B, or C" would include but not be limited to systems that have A alone, B alone, C alone, A and B together, A and C together, B and C together, and/or A, B, and C together, etc. It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

From the foregoing, it will be appreciated that various implementations of the present disclosure have been described herein for purposes of illustration, and that various modifications may be made without departing from the scope and spirit of the present disclosure. Accordingly, the various implementations disclosed herein are not intended to be limiting, with the true scope and spirit being indicated by the following claims.

What is claimed is:

1. A device implementable on a firearm, comprising:

a dust cover as a monolithic piece having a plurality of components comprising:

a cover plate;

a first connection portion;

a second connection portion; and a third connection portion, wherein the dust cover is pivotably coupled to a receiver portion of the firearm without any pin to pivot between an open position and a closed position such that:

the first connection portion is received in a cavity of a first hinge knuckle on the receiver portion of the firearm next to a first long side of an ejection port of the receiver portion of the firearm, and the third connection portion latches onto a second long side of the ejection port opposite the first long side thereof when the dust cover is in the closed position on the receiver portion of the firearm.

2. The device of claim 1, wherein, when the dust cover is in the open position on the receiver portion of the firearm, the cover plate uncovers the ejection port, and, wherein, when the dust cover is in the closed position on the receiver portion of the firearm, the cover plate covers the ejection port.

3. The device of claim 1, wherein the third connection portion is elastically deformable to allow a protrusion on the third connection portion to latch onto the second long side of the ejection port.

4. The device of claim 1, wherein the first connection portion of the dust cover is elastically deformable to allow the dust cover to be pivotably coupled to a receiver portion of the firearm.

5. The device of claim 4, wherein the first connection portion is separated from the cover plate by a gap which, when the dust cover is coupled to the receiver portion of the firearm, extends radially from a dust cover pivotal axis around which the dust cover is pivotably coupled to the receiver portion of the firearm.

6. The device of claim 1, wherein, when the dust cover is pivotably coupled to a receiver portion of the firearm, the second connection portion is received in a cavity of a second hinge knuckle on the receiver portion of the firearm next to the first long side of the ejection port.

7. The device of claim 6, wherein the second connection portion of the dust cover is elastically deformable to allow the dust cover to be pivotably coupled to the receiver portion of the firearm.

8. The device of claim 7, wherein the second connection portion is separated from the cover plate by a gap which, when the dust cover is coupled to the receiver portion of the firearm, extends radially from a dust cover pivotal axis around which the dust cover is pivotably coupled to the receiver portion of the firearm.

9. The device of claim 1, wherein the dust cover is made of polymer.

10. The device of claim 1, wherein the dust cover is made of metal.

11. An apparatus, comprising:

a firearm comprising a receiver portion having an ejection port; and a dust cover as a monolithic piece having a plurality of components comprising:

a cover plate;

a first connection portion;

a second connection portion; and a third connection portion, wherein the dust cover is pivotably coupled to a receiver portion of the firearm without any pin to pivot between an open position and a closed position such that:

the first connection portion is received in a cavity of a first hinge knuckle on the receiver portion of the firearm next to a first long side of an ejection port of the receiver portion of the firearm, and the third connection portion latches onto a second long side of the ejection port opposite the first long side thereof when the dust cover is in the closed position on the receiver portion of the firearm.

12. The apparatus of claim 11, wherein, when the dust cover is in the open position on the receiver portion of the firearm, the cover plate uncovers the ejection port, and, wherein, when the dust cover is in the closed position on the receiver portion of the firearm, the cover plate covers the ejection port.

13. The apparatus of claim 11, wherein the third connection portion is elastically deformable to allow a protrusion on the third connection portion to latch onto the second long side of the ejection port.

14. The apparatus of claim 11, wherein the first connection portion of the dust cover is elastically deformable to allow the dust cover to be pivotably coupled to a receiver portion of the firearm.

15. The apparatus of claim 14, wherein the first connection portion is separated from the cover plate by a gap which, when the dust cover is coupled to the receiver portion of the firearm, extends radially from a dust cover pivotal axis around which the dust cover is pivotably coupled to the receiver portion of the firearm.

16. The apparatus of claim 11, wherein, when the dust cover is pivotably coupled to a receiver portion of the firearm, the second connection portion is received in a cavity of a second hinge knuckle on the receiver portion of the firearm next to the first long side of the ejection port.

17. The apparatus of claim 16, wherein the second connection portion of the dust cover is elastically deformable to allow the dust cover to be pivotably coupled to the receiver portion of the firearm.

18. The apparatus of claim 17, wherein the second connection portion is separated from the cover plate by a gap which, when the dust cover is coupled to the receiver portion of the firearm, extends radially from a dust cover pivotal axis around which the dust cover is pivotably coupled to the receiver portion of the firearm.

19. The apparatus of claim 11, wherein the dust cover is made of polymer or metal.

20. The apparatus of claim 11, wherein the firearm comprises a rifle, carbine or pistol based on an AR-15 platform, and wherein the receiver portion comprises a receiver based on the AR-15 platform.

* * * * *